United States Patent [19]

Brown

[11] Patent Number: 4,653,543

[45] Date of Patent: Mar. 31, 1987

[54] LOOM REED SERVICING APPARATUS AND METHOD

[76] Inventor: Robert L. Brown, 108 Gilder Creek Dr., Simpsonville, S.C. 29681

[21] Appl. No.: 797,596

[22] Filed: Nov. 12, 1985

[51] Int. Cl.[4] ..... D03J 1/02; B08B 3/12; B01F 11/02

[52] U.S. Cl. ..... 139/1 C; 134/1; 366/127

[58] Field of Search ..... 139/1 C, 1 R; 366/127; 68/3 SS; 134/1, 184

[56] References Cited

U.S. PATENT DOCUMENTS

| | | | |
|---|---|---|---|
| 2,891,176 | 6/1959 | Branson | 366/127 |
| 3,089,790 | 5/1963 | Balamuth et al. | 68/3 SS |
| 3,503,805 | 3/1970 | Denyes | 366/127 |
| 3,596,833 | 8/1971 | Breech | 366/127 |
| 3,640,295 | 2/1972 | Peterson | 134/1 |
| 3,893,869 | 7/1975 | Mayer et al. | 134/184 |
| 4,409,999 | 10/1983 | Pedziwiati | 134/184 |
| 4,527,596 | 7/1985 | Kägi | 139/1 C |

FOREIGN PATENT DOCUMENTS

| | | | |
|---|---|---|---|
| 4512961 | 9/1966 | Japan | 134/1 |

*Primary Examiner*—Werner H. Schroeder
*Assistant Examiner*—Joseph S. Machuga
*Attorney, Agent, or Firm*—Bailey & Hardaway

[57] ABSTRACT

Apparatus and method is illustrated for servicing a loom reed at the loom with the warp yarns remaining in the reed. The apparatus includes a cleaning tank for ultrasonically cleaning the loom for reed as well as a tank for ultrasonically rinsing the loom reed. An elongated receptical for air cleaning and drying the loom reed is also illustrated.

5 Claims, 3 Drawing Figures

LOOM REED SERVICING APPARATUS AND METHOD

BACKGROUND OF THE INVENTION

It is common practice to service loom reeds at the loom utilizing a portable tank of cleaning liquid together with scrubbing brushes. An air supply from the mill is then utilized in order to blow off the reed drying the cleaning liquid and removing loose lint and sizing accumulation as may be dislodged during cleaning. It is desirable that cleaning take place at the loom to avoid cutting out the warp. If the wrap yarns are cut out preparatory to cleaning, it is then necessary to draw in each of the ends of the yarn after cleaning and replacing of the reed. Such cleaning of the reed away from the loom has been accomplished utilizing a tank containing cleaning fluid to which ultrasonic energy is applied. Such ultrasonic cleaning actions are followed by blow off of the loom reed with the dislodged contaminants being blown off into the room.

Both of the methods outlined above have the disadvantage of failing to thoroughly clean the loom reed in that contaminants remain on the reed to increase the build up of new contaminants resulting in the necessity of frequent cleaning operations with resulting expensive down time.

Accordingly it is an important object of the present invention to remove the cleaning liquid from the loom reed by means of a rinsing operation and an air treatment so as to thus thoroughly clean the loom reed discouraging the build up of lint, size and other contaminants.

Another important object of the invention is to ultrasonically clean a loom reed, with the warp yarns remaining therein, at the loom while providing an apparatus for carrying out a rinsing operation ultrasonically which may then be followed by an application of air to dry the reed of rinse liquid while collecting contaminants which had been dislodged by cleaning and rinsing.

SUMMARY OF THE INVENTION

It has been found that a cleaning action may be more effectively applied at the loom by utilizing ultrasonic cleaning followed by ultrasonic rinsing. These cleaning and rinsing steps are sequentially accomplished with the warp yarns remaining in the reed. The cleaning and rinsing steps are followed by air treatment for drying and exerting a final cleaning action upon the reed without damaging the warp yarns remaining in the reed.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
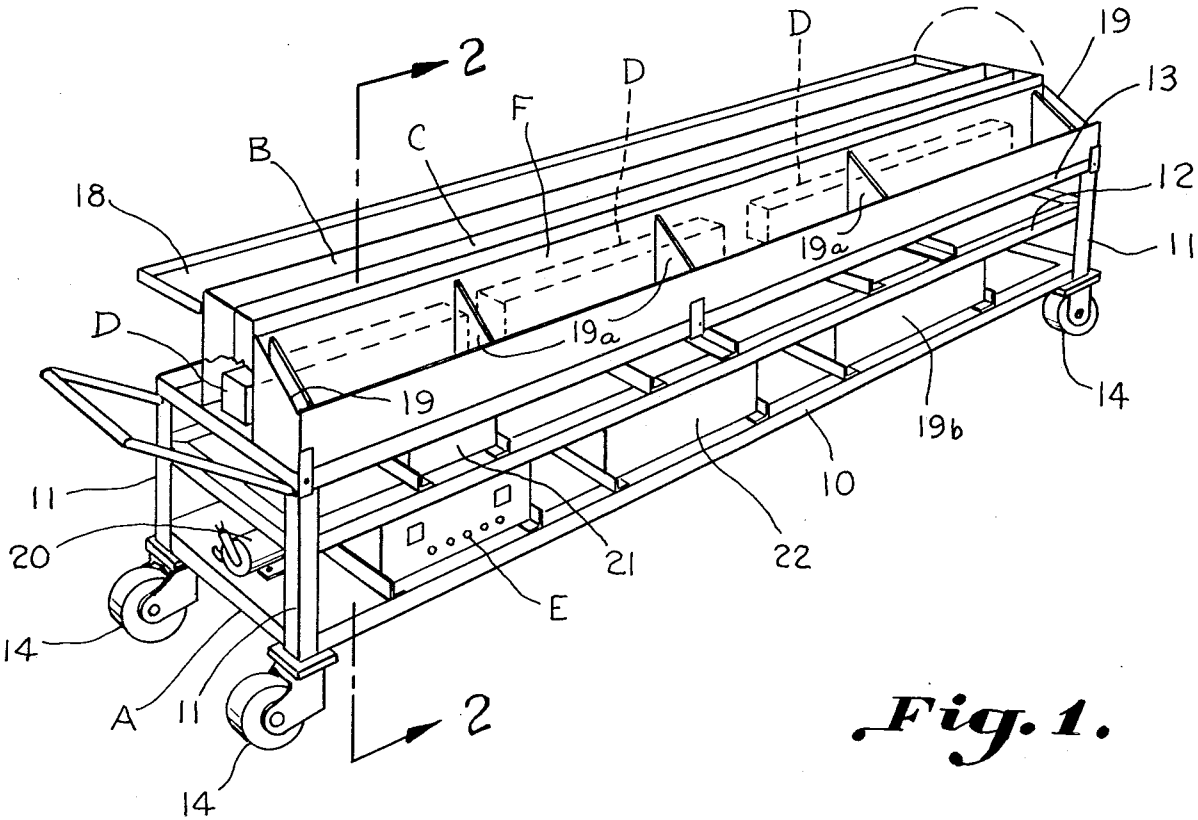
FIG. 1 is a perspective view illustrating a loom reed servicing apparatus constructed in accordance with the present invention.

The drawings illustrate a portable ultrasonic apparatus for servicing loom reeds at the loom with the warp yarns remaining.in the reeds. An elongated wheeled cart A carries a first elongated tank B for containing a cleaning liquid and accommodating a loom reed for drawing therein. A second elongated tank C for containing a rinsing liquid is carried by the cart adjacent and in alignment with the first elongated tank accommodating a loom reed for rinsing. Transducer means D is carried by the cart beneath the first and second tanks for driving the cleaning liquid for ultrasonic cleaning of the loom reed and the rinsing liquid for rinsing said loom reed. Generator means E is provided to supply power to the transducer means carried by the cart. An elongated receptacle is provided for air cleaning and drying of the loom reed carried by said cart.

The first and second tanks are closely adjacent each other and vertically disposed for receiving said loom reed. It is preferred that the loom reed be received in a horizontal or inclined upright position as shown for cleaning and rinsing respectively. A plurality of aligned transducers D are spaced along the first and second tanks, each transducer being in driving relation with both a portion of the first tank and an adjacent portion of the second tank. A single generator E sequentially drives each of the transducers.

The servicing of a loom reed includes subjecting the loom reed at the loom, with the warp yarns remaining in the reed, to the action of a cleaning liquid to which an ultrasonic force is applied for a time sufficient to apply a cleaning action to the reed. Then the loom reed, with the warp yarns remaining in the reed is subjected to the action of a rinsing liquid to which an ultrasonic force is applied for a time sufficient to apply a rinsing action to the reed. Then an air cleaning and drying action is applied to the loom reed without damaging the warp yarns in the reed.

The cart A includes a substantially rectangular lower frame member 10 which carries an upright member 11 on each corner for supporting a rectangular intermediate frame 12 and an upper frame 13. Suitable locking swivel casters 14 are provided in each corner of the lower frame for making the cart and apparatus carried thereby moveable for use in the mill for moving from one loom to another in order to service the respective loom reeds.

Figure 2:
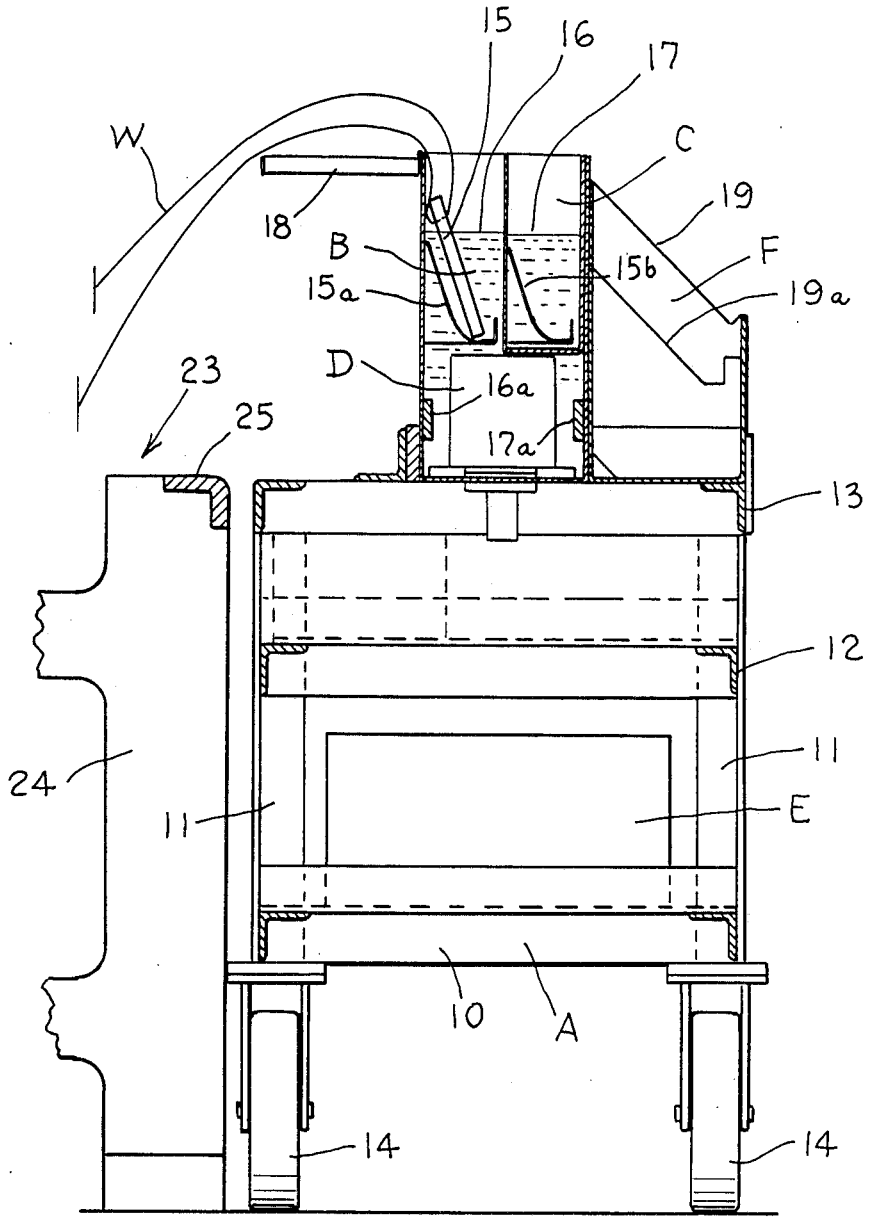
FIG. 2 is an enlarged transverse sectional elevation taken on the line 2—2 in FIG. 1 illustrating the reed servicing apparatus positioned at the loom.

The first elongated tank B is illustrated as extending longitudinally of the elongated cart A and is carried by the upper rectangular frame 13. The tank B is relatively narrow and is vertical for accommodating a loom reed 15 in upright inclined position (FIG. 2). The rinse tank contains a level of water 17 which is substantially at the same level as the cleaning fluid 16 carried within the cleaning tank B. It will be noted in FIGS. 1 and 2 that the transducers D are spaced along the respective cleaning and the rinsing tanks B and C and are positioned there-beneath so as to ultrasonically drive the liquid contained in each of the tanks. In order to prevent the tanks from becoming contaminated when not in use, a sliding cover 18 is provided. It is desirable that the respective tanks be narrow in order to minimize power consumption by utilizing a minimum of liquid necessary to receive the reed. The reed racks 15*a* and 15*b* support the reed in the respective tanks, with the warp W out of the liquid to avoid damage to the yarn and with the reed spaced above the transducers.

The air cleaning and drying is accomplished through the use of an elongated receptacle F which provides end supports 19 and brackets 19*a* for reception of the loom reed within the receptacle. An air supply from the mill may be utilized for blow off of the loom reed collecting contaminants in the receptacle F. If desired, a suction action may be exerted through a vacuum head (not shown) for vacuuming the reed which is carried on a surface such as 19. A source of air preferably a vacuum may be supplied by the vacuum box 19b carried by the cart. If blowing off is preferred the mill air supply may be used or a source of compressed air carried by the cart. Whether the air action is one of blowing off or suction as in vacuuming, it is important that the reed be dried before replacing it upon the loom, and it is desirable to collect the contaminants dislodged in cleaning and rinsing either in the elongated receptacle or in the vacuum apparatus.

A pump is illustrated at 20 having suitable connections to pump the cleaning liquid in or out of the tank B which the pump may pump the water rinse liquid in or out of the tank C. It is desirable that strip heaters 16*a* and 17*a* (FIG. 2) extend along the inside of the lower portion of the tank A to bring the liquid up to standard operating temperature of about 140° F. where it should be then maintained by the heaters.

Due to the limited availability of power outlets within a textile mill, it is necessary to operate only one of the spaced transducers D at a time. Ordinarily this would be accomplished by providing a generator for driving each of the respective transducers one at a time. It has been found possible, however, to economically operate the respective transducers one at a time, switching the output of a single generator to each of the respective transducers in any desired sequence. By utilizing only one generator to service all of the transducers there is a saving of weight which is important in the portable device which must be moved from loom to loom.

Figure 3:
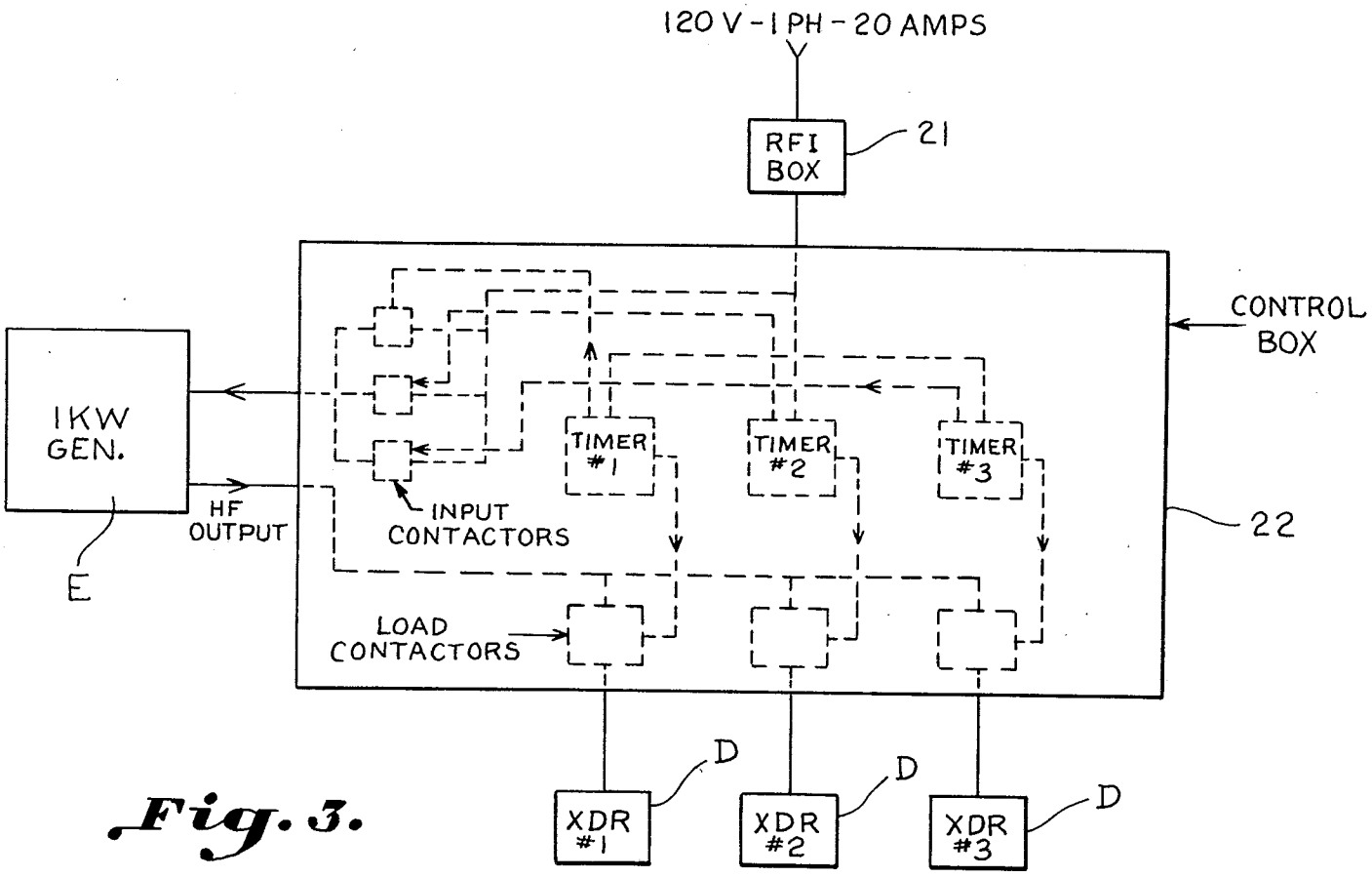
FIG. 3 is a schematic diagram illustrating the electrical components utilized in applying ultrasonic energy to the cleaning tank and rinse tank.

FIG. 3 illustrates the output of the generator E being applied to the respective transducers D in accordance with the action of Timers 1, 2 and 3. A suitable filter in the form of a radio frequency inhibitor box is provided at 21. The components may be positioned in a control box 22.

In operation the casters are locked with the cart positioned in front of a loom broadly illustrated at 23 in FIG. 2 where the loom frame 24 is illustrated as carrying the usual breast beam 25. The warp is let off or slackened to permit the loom reed with the warp W therein to be placed first in the cleaning tank and then the rinsing tank for sequential ultrasonic cleaning and rinsing preparatory to air drying and final cleaning of the loom reed.

By utilizing a sliding cover 18 it is possible to close off the cleaning tank A after the cleaning step has been carried out. This prevents evaporation and contamination of the heated cleaning liquid. The warp yarns are also prevented from entering the cleaning tank as they extend thereover to permit placing of the reed in the rinsing tank. During blow off or vacuuming the cover 18 is placed over both tanks A and B to prevent contamination of the liquid contained in the tanks.

While a preferred embodiment of the invention has been described using specific terms, such description is for illustrative purposes only, and it is to be understood that changes and variations may be made without departing from the spirit or scope of the following claims.

What is claimed is:

1. A moveable ultrasonic apparatus for servicing loom reeds at the loom with the warp yarns remaining in the reeds comprising:

an elongated wheeled cart;

a first elongated tank for containing a cleaning liquid carried by said cart accommodating a loom reed for cleaning;

a second elongated tank for containing a rinsing liquid carried by said cart adjacent and in alignment with said first elongated tank accommodating a loom reed for rinsing;

transducer means carried by said cart beneath said first and second tanks for driving said cleaning liquid for ultrasonic cleaning of said loom reed and said rinsing liquid for rinsing said loom reed; and generator means supplying power to said transducer means carried by said cart.

2. The structure set forth in claim 1 including an elongated receptacle for air cleaning and drying of said loom reed carried by said cart.

3. The structure set forth in claim 1 wherein said first and second tanks are closely adjacent each other and vertically disposed for receiving said loom reed in an upright position for cleaning and rinsing respectively, and a plurality of aligned transducers spaced along said first and second tanks each transducer being in driving relation with both a portion of said first tank and an adjacent portion of said second tank.

4. The structure set forth in claim 3 wherein a single generator sequentially drives each of said transducers.

5. The method of servicing a loom reed comprising the steps of:

subjecting the loom reed at the loom, with the warp yarns remaining in the reed, to the action of a cleaning liquid to which an ultrasonic force is applied for a time sufficient to apply a cleaning action to the reed;

then subjecting the loom reed, with the warp yarns remaining in the reed, to the action of a rinsing liquid to which an ultrasonic force is applied for a time sufficient to apply a rinsing action to the reed, and then applying an air cleaning and drying action to the loom reed without damaging the warp yarns in the reed.

* * * * *

Notice of Adverse Decisions in Interference

In Interference No. 101,811, involving Patent No. 4,653,543, R. L. Brown, LOOM REED SERVICING APPARATUS AND METHOD, final judgement adverse to the patentee was rendered Dec. 27, 1989, as to claims 1-4.

[*Official Gazette October 23, 1990*]